US007210313B1

(12) United States Patent
Kay

(10) Patent No.: US 7,210,313 B1
(45) Date of Patent: May 1, 2007

(54) RELEASE MECHANISM FOR A BANGLE

(76) Inventor: Scott Kay, 780 Palisade Ave., Teaneck, NY (US) 07666

( * ) Notice: Subject to any disclaimer, the term of this patent is extended or adjusted under 35 U.S.C. 154(b) by 0 days.

(21) Appl. No.: 10/754,746

(22) Filed: Jan. 8, 2004

(51) Int. Cl.
*A44C 5/00* (2006.01)

(52) U.S. Cl. ..... 63/3.1; 63/3; 63/7; 63/9; 63/8; 63/11

(58) Field of Classification Search ..... 63/3.1, 63/7, 8, 4, 11
See application file for complete search history.

(56) References Cited

U.S. PATENT DOCUMENTS

| | | | | | |
|---|---|---|---|---|---|
| 125,516 | A | * | 4/1872 | Barclay | 63/6 |
| 255,610 | A | * | 3/1882 | Faas | 63/6 |
| 273,241 | A | * | 2/1883 | Moore | 24/662 |
| 704,243 | A | * | 7/1902 | Davis | 63/9 |
| 1,403,600 | A | * | 1/1922 | Grand et al. | 63/11 |
| 2,180,980 | A | * | 11/1939 | Fassnacht et al. | 63/7 |
| 2,626,736 | A | * | 1/1953 | Korth | 224/220 |
| 3,805,548 | A | * | 4/1974 | Matwijcow | 63/8 |
| 4,033,143 | A | * | 7/1977 | Michael | 63/15 |
| 4,055,057 | A | | 10/1977 | Kolman | |
| 4,401,388 | A | | 8/1983 | Mearns | |
| 4,674,299 | A | * | 6/1987 | Azar | 63/7 |
| 4,763,490 | A | | 8/1988 | Bruner | |
| 4,803,852 | A | * | 2/1989 | Waldron | 63/13 |
| 4,879,883 | A | | 11/1989 | Bruner | |
| 5,054,299 | A | * | 10/1991 | Maveety | 63/3 |
| 5,074,127 | A | * | 12/1991 | Yurman | 63/3 |
| 5,468,220 | A | * | 11/1995 | Sucher | 602/21 |
| 5,522,529 | A | * | 6/1996 | Yurman et al. | 224/176 |
| D371,980 | S | | 7/1996 | Gardner | |
| 5,598,722 | A | | 2/1997 | Leach, II et al. | |
| 5,605,059 | A | | 2/1997 | Woodward | |

(Continued)

OTHER PUBLICATIONS http://www.davidyurman.com.*

(Continued)

*Primary Examiner*—Robert J. Sandy
*Assistant Examiner*—David Reese
(74) *Attorney, Agent, or Firm*—Kenneth S. Weitzman

(57) ABSTRACT

A bangle includes first and second bangle members, each having a proximal end and a distal end. The distal end of the first bangle member is pivotally connected to the distal end of the second bangle member to permit relative movement between the first and second bangle members. A first locking member is provided at the proximal end of the first bangle member and a second locking member is provided at the proximal end of the second bangle member. The first locking member is selectively moveable between a closed position where the first locking member engages the second locking member to releasably secure the proximal end of the first bangle member to the proximal end of the second bangle member, and an open position where the first locking member is separated from the second locking member. The first locking member is adapted to be released from the closed position and move to the open position when a force is applied to the first and second bangle members sufficient to cause the first and second bangle members to pivot a predetermined distance in a direction where the proximal ends move toward one another. This force can be applied by squeezing the first and second bangle members between two fingers on the same hand.

36 Claims, 5 Drawing Sheets

U.S. PATENT DOCUMENTS

| | | | | |
|---|---|---|---|---|
| 5,746,067 | A * | 5/1998 | Leach et al. | 63/7 |
| 5,816,072 | A * | 10/1998 | Michaels | 63/3 |
| D400,464 | S | 11/1998 | Kothari | |
| D401,527 | S | 11/1998 | Kelman | |
| D413,531 | S | 9/1999 | Philippe | |
| 6,041,479 | A | 3/2000 | Colpo | |
| D442,508 | S | 5/2001 | Torres | |
| 6,349,453 | B1 | 2/2002 | Nicoletti et al. | |
| D456,296 | S | 4/2002 | Ambar | |
| D470,429 | S | 2/2003 | Bonnet | |
| D474,423 | S | 5/2003 | James | |
| 6,675,612 | B2 * | 1/2004 | Nanasi | 63/3.2 |
| 2003/0164003 | A1 | 9/2003 | Nanasi | |
| 2004/0025984 | A1 * | 2/2004 | Holemans et al. | 148/563 |

OTHER PUBLICATIONS http://search.rubylane.com/jewelry/,id=4.15.html.*
http://www.jewelryimpressions.jcom/14ktgold/bangle.html.*
http://www.jewellerycatalogue.co.uk/gold/gold-stock/bn371.php.*
http://www.anzorjewelrycorp.com/scripts/prodView.asp?aku=B141.*
http://www.scottkaysterling.com/got_flash/index.html.*
http://www.dragonweave.com/cuff-bracelets.html.*
http://www.vermontbracelet.com/picture.html.*

* cited by examiner

RELEASE MECHANISM FOR A BANGLE

BACKGROUND OF THE INVENTION

1. Field of the Invention

The present invention relates generally to jewelry clasps for releasably coupling ends of an article of jewelry together and, more particularly, to a mechanism for releasably connecting the terminal ends of a bangle, bracelet, or the like.

2. Description of the Related Art

Jewelry items are commonly draped or fastened about the wrist, ankle, finger, neck, or other appendage of a person to accessorize that person's appearance. One example of such a jewelry item is a bangle. In general, a bangle is a bracelet or anklet that typically has one or more rigid arcuate sections designed to substantially encircle the wrist, ankle or other appendage of the person wearing it. Most bangles are designed to appear as a solid, substantially continuous loop having an arcuate, oblong, ring-like, round or circular configuration.

Many bangles are in the form of a continuous or substantially continuous loop having at least two releasably coupled, rigid arcuate sections that can be selectively opened to permit the person wearing it to be place the bangle on or remove it from the wrist, ankle or other appendage. A hinge at one intersection of the rigid arcuate sections permits the bangle to be selectively moved from an open position to a closed position, and vice versa. A closing or locking mechanism is typically provided at the opposing intersection of the rigid arcuate sections to releasably retain the bangle in the closed position about the wrist, ankle or other appendage of the person wearing it.

Because the bangle is frequently worn on a person's wrist, it is necessary for the person wearing it to be able to release or open the closing or locking mechanism with one hand. As a result, many bangles of this type can be difficult to remove. It is, therefore, desirable to provide an improved bangle that provides ease for removal using one hand, preferably two digits on a single hand.

SUMMARY OF THE INVENTION

In accordance with a preferred embodiment, a bangle is provided that includes first and second bangle members, each having a proximal end and a distal end. The distal end of the first bangle member is pivotally connected to the distal end of the second bangle member to permit relative movement between the first and second bangle members. A first locking member is provided at the proximal end of the first bangle member and a second locking member is provided at the proximal end of the second bangle member. The first locking member is selectively moveable between a closed position where the first locking member engages the second locking member to releasably secure the proximal end of the first bangle member to the proximal end of the second bangle member, and an open position where the first locking member is separated from the second locking member. The first locking member is adapted to be released from the closed position and move to the open position when a force is applied to the first and second bangle members sufficient to cause the first and second bangle members to pivot a predetermined distance in a direction where the proximal ends move toward one another. This force can be applied by squeezing the first and second bangle members between two fingers on the same hand.

The foregoing specific objects and advantages of the invention are illustrative of those that can be achieved by the present invention and are not intended to be exhaustive or limiting of the possible advantages which can be realized. Thus, these and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF THE DRAWINGS

Further aspects of the instant invention will be more readily appreciated upon review of the detailed description of the embodiments included below when taken in conjunction with the accompanying drawings, of which.

DETAILED DESCRIPTION

Figure 1:
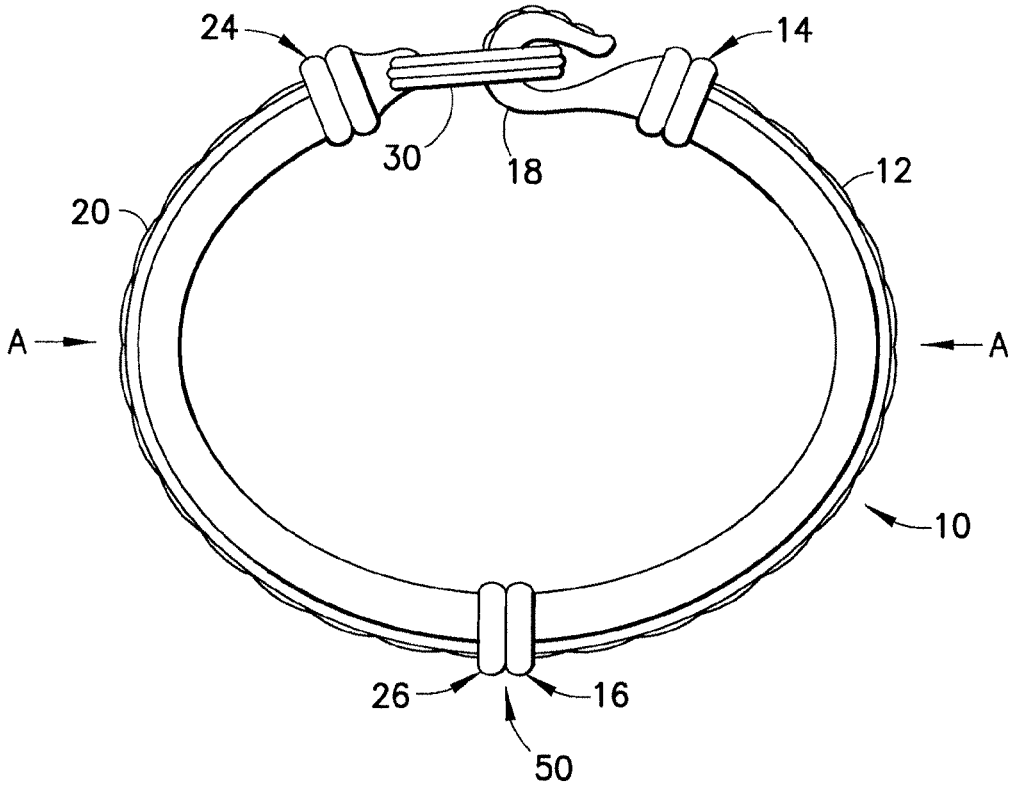
FIG. 1 is a side elevation view of a preferred embodiment of the bangle shown in a closed or locked position.

Referring now to FIGS. 1–7, wherein similar components are numerically referenced in like manner, disclosed is a preferred embodiment of a jewelry clasp system for a jewelry article and, in particular, for a bangle-type bracelet.

FIGS. 1–7 illustrate a preferred embodiment of a bangle or bracelet 10 in accordance with the present invention. The bangle 10 preferably includes a first arcuate section 12 and a second arcuate section 20 to be coupled together to form a substantially continuous loop having an oblong, elliptical, arcuate, round, ring-like and/or circular configuration. The first and second arcuate sections 12, 20 can be made from a variety of materials, preferably a precious metal such as gold, platinum, silver, etc. In addition, the first and second arcuate sections 12, 20 can be adorned with a gems, stones, braiding, weaving, or other aesthetically pleasing appearances.

The first arcuate section 12 has opposing first and second terminal portions 14 and 16, respectively. The first terminal portion 14 of the first arcuate section 12 terminates in a hook 18, which is preferably formed integrally as part of the first arcuate section 12. In the preferred embodiment, the hook 18 is substantially C-shaped.

The second arcuate section 20 also has opposing first and second terminal portions 24 and 26, respectively. The first terminal portion 24 of the second arcuate section 20 terminates in a loop 30. The loop 30 is preferably made of the same material as the first and second arcuate sections 12, 20.

Figure 2:
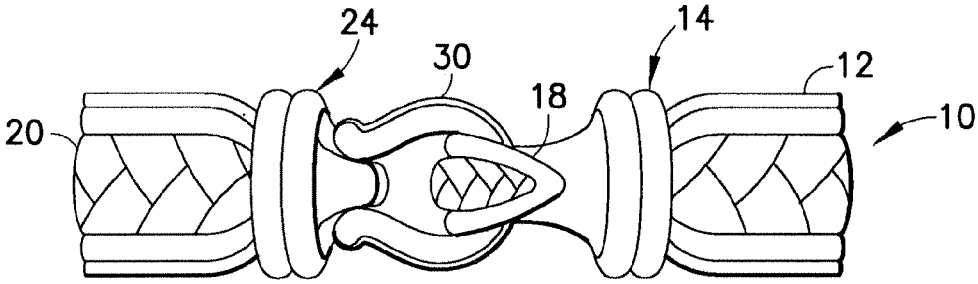
FIG. 2 is a top plan view of the bangle of FIG. 1.

As will be discussed in further detail below, the loop 30 is selectively movable between an open and a closed position. In the closed position, as shown in FIGS. 1 & 2, the loop 30 cooperates with the hook 18 formed on the first arcuate section 12 to releasably secure the first terminal portion 14 of the first arcuate section 12 to the first terminal portion of the second arcuate section 20. In the open position, as shown in FIGS. 3 & 4, the loop 30 does not engage the hook 18, thereby allowing the bangle 10 to be place on or removed from an appendage of the person wearing it.

Figure 5:
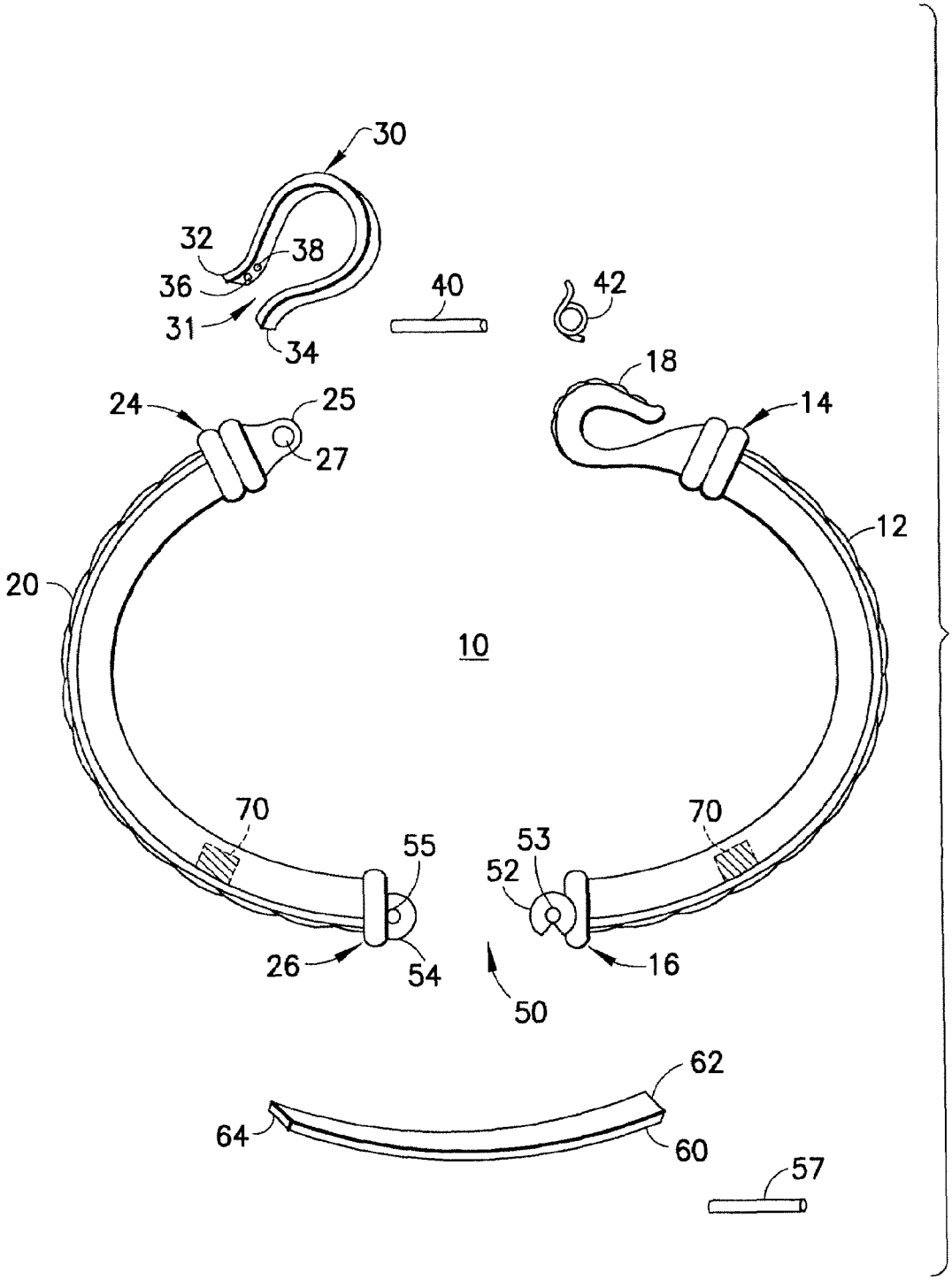
FIG. 5 is an exploded view of the various components of the bangle of FIG. 1.

The assembly of the loop 30 to the first terminal portion 24 of the second arcuate section 20 is best described with reference to FIG. 5. The first terminal portion 24 preferably terminates in a projecting flange 25 having a transverse bore or opening 27 therethrough. The loop 30 is preferably, but not necessarily, in the shape of a horseshoe having an opening 31 formed between two spaced apart ends 32, 34. The opening 31 is of sufficient width to receive the projecting flange 25 between the spaced apart ends 32, 34 when the loop 30 is assembled onto the first terminal portion 24 of the second arcuate section 20. A concentric hole or opening 36 is formed through each end 32, 34 such that, when the loop 30 is assembled onto the first terminal portion 24, the concentric holes 36 are aligned with the transverse bore 27 through the projecting flange 25. A pin 40 of sufficient diameter is inserted through one of the concentric holes 36, the transverse bore 27, and then other concentric hole 36 to pivotally secure the ends 32, 34 of the loop 30 to the first terminal portion 24 of the second arcuate section 20. The pin 40 can be secured to the loop 30 in a conventional manner.

Figure 3:
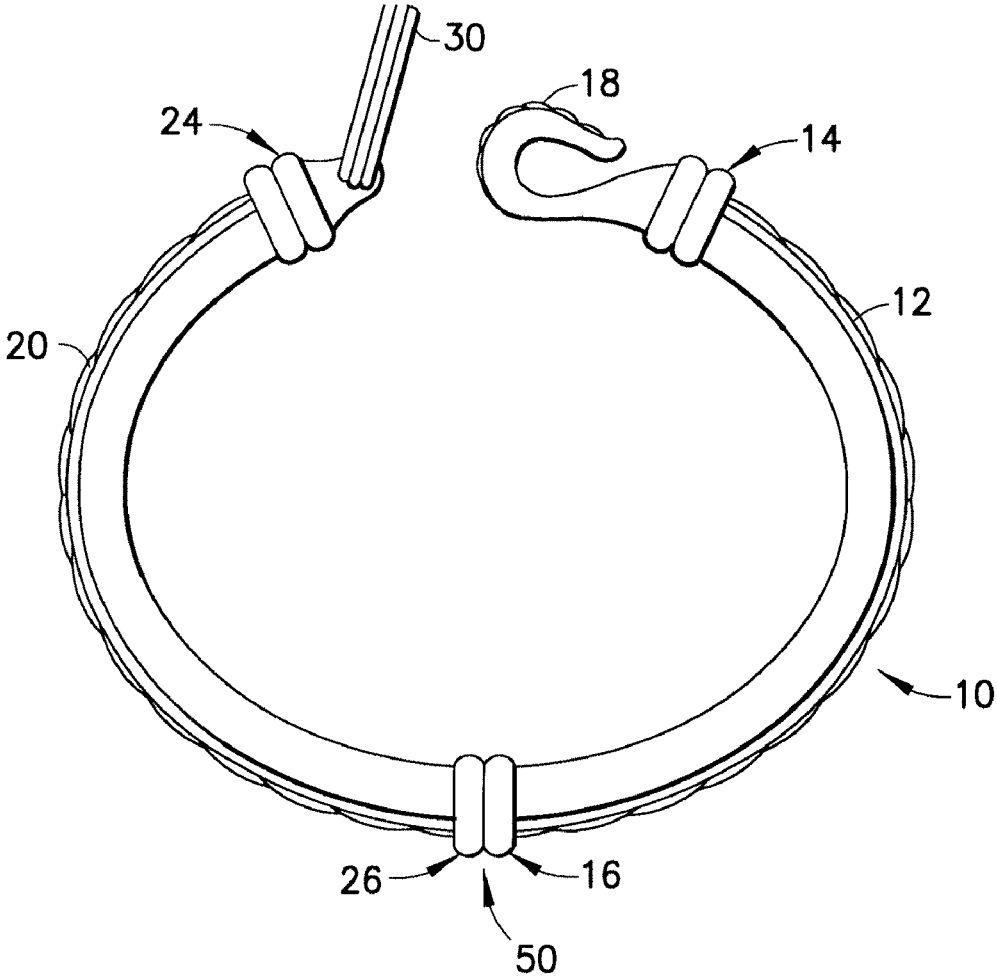
FIG. 3 is a side elevation view of the bangle of FIG. 1 shown in the open or unlocked position.
Figure 4:
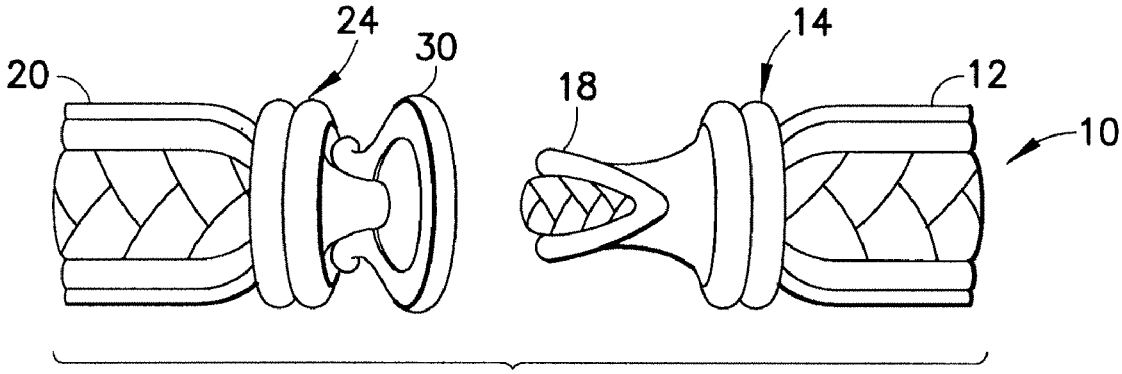
FIG. 4 is a top plan view of the bangle of FIG. 3.

The loop 30 is preferably biased toward the open position away from the hook 18 as shown in FIGS. 3 & 4. Referring again to FIG. 5, a spring 42 is utilized to bias the loop 30 toward the open position. The spring 42 is preferably a stainless steel coil spring of sufficient size to be inserted into the transverse bore 27 through the projecting flange 25 prior to assembly of the loop 30 onto the flange 25. In a preferred embodiment, the transverse bore 27 includes a detent or indentation for retaining one end of the spring 42 to prevent the spring from rotating within the transverse bore. When the loop 30 is assembled onto the projecting flange 25, the other end of the spring 42 is received within a recess or hole 38 formed in the end 32 of the loop 30, compressing the spring 42 (or placing it in tension) and biasing the loop 30 toward the open position away from the hook 18.

The second terminal portion 16 of the first arcuate sections 12 is connected to the second terminal portion 26 of the second arcuate section 20 via a hinge 50. The hinge 50 allows the first and second arcuate sections 12, 20 to pivot relative to each other, thereby permitting the bangle 10 to move between the open and closed positions.

Figure 6:
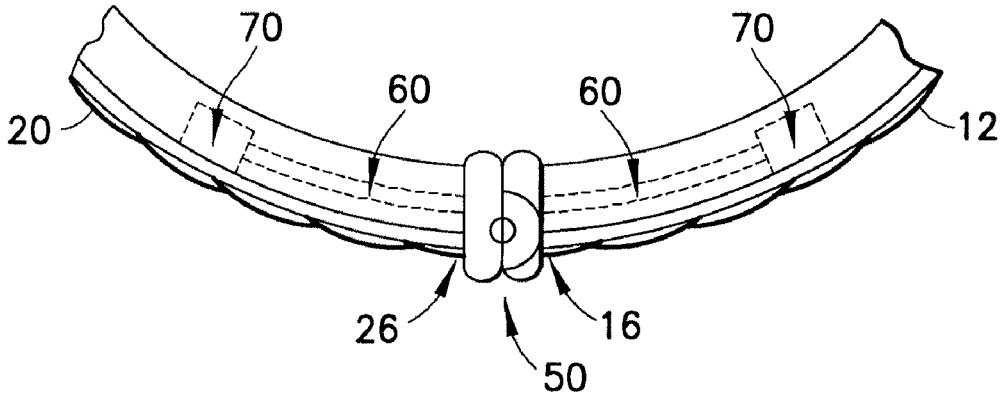
FIG. 6 is a partial side elevation view of the preferred hinge assembly of the bangle of FIG. 1.
Figure 7:
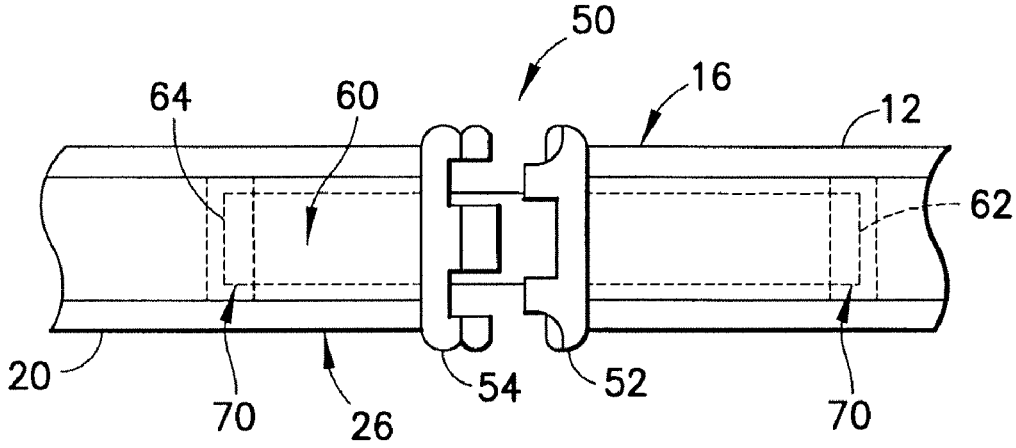
FIG. 7 is a bottom plan view of the preferred hinge assembly illustrated in FIG. 6.
Figure 8:
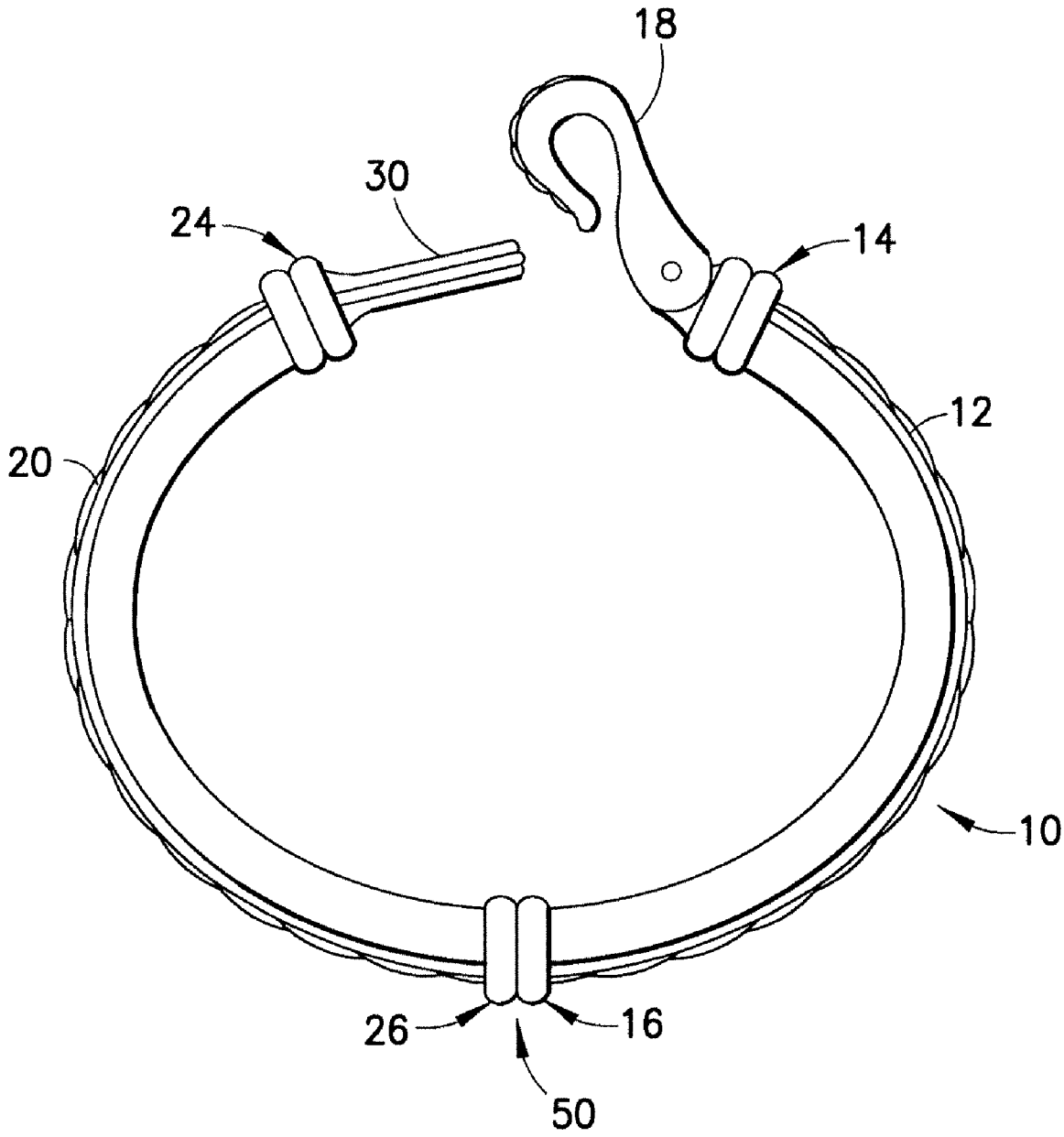
FIG. 8 is a side elevation view of an open bangle in accordance with an embodiment of the present invention.

The preferred assembly of the hinge 50 is best described with reference to FIGS. 5–7. The second terminal portion 16, 26 of the first and second arcuate sections terminates in a female and male hinge portion 52 and 54, respectively. A transverse concentric bore 53, 55 is provided through the female and male hinge portions 52, 54 such that, when the female and male hinge portions are aligned with one another, a pin 57 can be inserted through the transverse concentric bores 53, 55 to pivotally secure the second terminal portion 16 of the first arcuate section 12 to the second terminal portion 26 of the second arcuate section 20.

In the preferred embodiment, a leaf spring 60 is positioned proximate the hinge 50 to bias the first and second arcuate sections 12, 20 toward the open position as illustrated in FIGS. 3 & 4. Preferably the leaf spring 60 is made from stainless steel. Referring again to FIGS. 5–7, the leaf spring 60 has a first end 62 and a second end 64. The first end 62 of the leaf spring 60 is inserted into an opening in the second terminal portion 16 of the first arcuate section 12 and the second end 64 of the leaf spring 60 is inserted into an opening in the second terminal portion 26 of the second arcuate section 20. A box-like retaining member 70 is provided within the opening in both the first and second arcuate sections 12, 20 to retain the ends 62, 64 of the spring 60. Because the spring 60 spans the hinge 50, the spring 60 tends to urge or bias the first terminal portions 14, 24 of the first and second arcuate sections away from each other toward the open position.

To place the bangle 10 onto or remove it from an appendage of the person wearing it, the first and second arcuate sections 12, 20 must be moved to the open position as shown in FIGS. 3 & 4. To do so, the user gently squeezes the first and second arcuate sections 12, 20 toward one another in the direction of arrow A shown in FIG. 1. This can be done, for example, using one hand by gently squeezing the first and second arcuate sections between the thumb and index finger (or other digit). When the force applied to the first and second arcuate sections 12, 20 exceeds the biasing force of spring 60, the second terminal portions 16, 26 pivot about the hinge 50 to cause the first portions 14, 24 of the first and second arcuate sections 12, 20 to move toward one another. When the first portions 14, 24 move toward one another a predetermined distance, the loop 30 becomes disengaged from the hook 18 and the spring 42 biases the loop away from the hook toward the open position. Once the loop 30 becomes disengaged from the hook 18, the user releases the squeezing force on the first and second arcuate sections and the spring 60 causes the second terminal portions 16, 26 to pivot in the opposing direction about the hinge 50, thereby moving the first portions 14, 24 of the first and second arcuate sections 12, 20 away from one another. In the open position, the first portions 14, 24 of the first and second arcuate sections 12, 20 are separated from one another to facilitate placing and/or removing the bangle 10 from an appendage (e.g., wrist, ankle, finger, etc.) of the person wearing it.

Once the bangle 10 is placed on an appendage of the person wearing it, the bangle can be moved to the locked, closed position as shown in FIGS. 1 & 2. To do so, the person wearing the bangle 10 gently squeezes the first and second arcuate sections 12, 20 toward one another in the direction of arrow A shown in FIG. 1. Again, this can be done, for example, using one hand by gently squeezing the first and second arcuate sections between the thumb and index finger (or other digit). When the force applied to the first and second arcuate sections 12, 20 exceeds the biasing force of spring 60, the second terminal portions 16, 26 pivot about the hinge 50 to cause the first portions 14, 24 of the first and second arcuate sections 12, 20 to move toward one another. When the first portions 14, 24 move toward one another a sufficient distance, the person wearing the bangle 10 manually depresses the loop 30 so that the loop falls below the upper end of the hook 18. The user then releases the squeezing force on the first and second arcuate sections and the spring 60 causes the second terminal portions 16, 26 to pivot in the opposing direction about the hinge 50, thereby moving the first portions 14, 24 of the first and second arcuate sections 12, 20 away from one another to engage the loop 30 on the hook 18. The bangle 10 is now secured in the locked, closed position as shown in FIGS. 1 & 2.

Although an illustrative preferred embodiment has been described herein in detail, it should be noted and will be appreciated by those skilled in the art that numerous variations may be made within the scope of this invention without departing from the principle of this invention and without sacrificing its chief advantages. For instance, the bangle 10 does not necessarily have to be round, oval-shaped or arcuate, but rather can be formed in other closed-loop configurations (e.g., a square, triangle, rectangle, polygon, octagon, or some other closed-loop configuration). In addition, other known types of springs and means of providing bias can be substituted for those disclosed in the preferred embodiment. Similarly, in contrast to the preferred embodiment, it is understood that the hook 18 may instead be moveable relative a fixed loop 30. In addition, it is understood that the bangle 10 is not necessarily limited to two arcuate sections and could include more than two arcuate sections as well. Moreover, while a C-shaped hook 18 and an oval or horseshoe-shaped loop 30 are illustrated in the figures, other shaped hooks (e.g., J-shaped, etc.) and loops (e.g., circular, rectangular, etc.) can be substituted for those disclosed in the preferred embodiment. Finally, the bangle 10 and its constituent pieces, the hook, and/or the loop may include precious metals, gems or jewels to provide additional aesthetic value to the bangle.

The terms and expressions have been used herein as terms of description and not terms of limitation. There is no intention to use the terms or expressions to exclude any equivalents of features shown and described or portions thereof and this invention should be defined in accordance with the claims that follow.

I claim:

1. A bangle, comprising:

first and second bangle members, each bangle member having a proximal end and a distal end, the distal end of the first bangle member being pivotally connected to the distal end of the second bangle member to permit relative movement between the first and second bangle members;

means for biasing the first and second bangle members in a direction where the proximal ends move away from one another; and a first locking member provided at the proximal end of the first bangle member and a second locking member provided at the proximal end of the second bangle member, the first locking member being selectively moveable between a closed position where the first locking member engages the second locking member to releasably secure the proximal end of the first bangle member to the proximal end of the second bangle member, and an open position where the first locking member is separated from the second locking member;

means for biasing the first locking member in a direction toward the open position, wherein the first locking member is released from the closed position and moves to the open position when a force is applied to the first and second bangle members sufficient to cause the first and second bangle members to pivot a predetermined distance in a direction where the proximal ends move toward one another.

2. The bangle according to claim 1, wherein the first locking member can be moved from the open position to the closed position after a force is applied to the first and second bangle members sufficient to cause the first and second bangle members to pivot in a direction where the proximal ends move a predetermined distance toward one another to permit the first locking member to engage the second locking member.

3. The bangle according to claim 1, wherein a first spring biases the first locking member in the direction toward the open position.

4. The bangle according to claim 1, wherein the first locking member includes an aperture and the second locking member includes a protruding element for releasably engaging the aperture in the first locking member when the first locking member is in the closed position.

5. The bangle according to claim 4, wherein the first locking member is a loop pivotally connected to the proximal end of the first bangle member.

6. The bangle according to claim 5, wherein the second locking member is hook-shaped to engage the aperture in the first locking member.

7. The bangle according to claim 1, wherein the second locking member includes an aperture and the first locking member includes a protruding element for releasably engaging the aperture in the second locking member when the first locking member is in the closed position.

8. The bangle according to claim 1, wherein a spring biases the first and second bangle members to pivot in a direction where the proximal ends move away from one another.

9. The bangle according to claim 1, wherein a hinge is provided at the distal end of the first and second members to pivotally connect the distal ends and allow movement of the first member relative the second member.

10. The bangle according to claim 8, wherein the spring is a leaf spring.

11. The bangle according to claim 10, wherein the first and second bangle members each have an opening formed in the distal end thereof, the spring having a first end and a second end, the first end of the spring being retained within the opening in the distal end of the first bangle member and the second end of the spring being retained within the opening in the distal end of the second bangle member.

12. The bangle according to claim 11, further comprising means for retaining the first and second ends of the spring within the respective openings formed in the distal end of the first and second bangle members.

13. The bangle according to claim 1, further comprising means for pivotally connecting the distal end of the first and second bangle members to permit relative movement between the first and second bangle members.

14. The bangle according to claim 1, wherein the first and second bangle members are elongated arcuate sections.

15. The bangle according to claim 1, wherein the bangle is configured to permit a user to release the first locking member from the closed position with one hand.

16. The bangle according to claim 15, wherein the bangle is configured to permit the user to release the first locking member from the closed position by squeezing the first and second bangle members between two digits on the one hand to apply the force on the first and second bangle members.

17. A bangle, comprising:

first and second arcuate sections, each arcuate section having a proximal end and a distal end, the distal end of the first arcuate section being pivotally connected to the distal end of the second arcuate section to permit relative movement between the first and second arcuate sections; and a first locking member provided at the proximal end of the first arcuate section and a second locking member provided at the proximal end of the second arcuate section, the first locking member being selectively moveable between a closed position where the first locking member engages the second locking member to releasably secure the proximal end of the first arcuate section to the proximal end of the second arcuate section, and an open position where the first locking member is separated from the second locking member;

means for biasing the first locking member in a direction toward the open position, and means for biasing the first and second arcuate sections in a direction where the proximal ends move away from one another, and the first locking member is released from the closed position and moves to the open position when a force is applied to the first and second arcuate sections sufficient to cause the first and second arcuate sections to pivot in a direction where the proximal ends move toward one another a predetermined distance.

18. The bangle according to claim 17, wherein the first locking member can be moved from the open position to the closed position after a force is applied to the first and second arcuate sections sufficient to cause the first and second arcuate sections to pivot in a direction where the proximal ends move a predetermined distance toward one another to permit the first locking member to engage the second locking member.

19. The bangle according to claim 17, wherein a first spring biases the first locking member in the direction toward the open position.

20. The bangle according to claim 19, wherein the first locking member includes an aperture and the second locking member includes a protruding element for releasably engaging the aperture in the first locking member when the first locking member is in the closed position.

21. The bangle according to claim 20, wherein the first locking member is a loop pivotally connected to the proximal end of the first arcuate section and the second locking member is hook-shaped to engage the aperture in the first locking member.

22. The bangle according to claim 21, wherein a hinge is provided at the distal end of the first and second arcuate section to pivotally connect the distal ends and a second spring biases the first and second arcuate sections to pivot about the hinge in a direction where the proximal ends move away from one another.

23. The bangle according to claim 22, wherein the second spring is a leaf spring having a first end and a second end, and the first and second arcuate sections each have an opening formed in the distal end thereof, the first end of the second spring being retained within the opening in the distal end of the first arcuate section and the second end of the second spring being retained within the opening in the distal end of the second arcuate section.

24. The bangle according to claim 23, further comprising means for retaining the first and second ends of the second spring within the respective openings formed in the distal end of the first and second arcuate sections.

25. The bangle according to claim 19, further comprising means for pivotally connecting the distal end of the first and second arcuate sections to permit relative movement between the first and second arcuate sections.

26. The bangle according to claim 17, wherein the bangle is configured to permit a user to release the first locking member from the closed position with one hand.

27. The bangle according to claim 26, wherein the bangle is configured to permit the user to release the first locking member from the closed position by squeezing the first and second arcuate sections between two digits on the one hand to apply the force on the first and second arcuate sections.

28. A release mechanism for opening a bangle having at least two elongated bangle members pivotally connected to one another at a distal end thereof, comprising:

a first locking member provided at a proximal end of one of the bangle members and a second locking member provided at a proximal end of an adjacent bangle member, the first locking member being selectively moveable between a closed position where the first locking member engages the second locking member to releasably secure the proximal end of the bangle member to the proximal end of the adjacent bangle member, and an open position where the first locking member is separated from the second locking member;

means for biasing the first locking member in a direction toward the open position, wherein the first locking member is released from the closed position and moves to the open position when a force is applied to the pivotally connected bangle members sufficient to cause the pivotally connected bangle members to pivot in a direction where the proximal ends move toward one another a predetermined distance; and means for biasing the pivotally connected bangle members in a direction where the proximal ends move away from one another.

29. The release mechanism according to claim 28, wherein the first locking member can be moved from the open position to the closed position after a force is applied to the pivotally connected bangle members sufficient to cause the pivotally connected bangle members to pivot in a direction where the proximal ends move toward one another a predetermined distance to permit the first locking member to engage the second locking member.

30. The release mechanism according to claim 28, wherein the first locking member includes an aperture and the second locking member includes a protruding element for releasably engaging the aperture in the first locking member when the first locking member is in the closed position.

31. The release mechanism according to claim 30, wherein the first locking member is a loop pivotally connected to the proximal end of one of the bangle members and the second locking member is hook-shaped to engage the aperture in the first locking member.

32. The release mechanism according to claim 30, further comprising means for connecting the first locking member to the proximal end of one of the bangle members.

33. The release mechanism according to claim 28, wherein the second locking member includes an aperture and the first locking member includes a protruding element for releasably engaging the aperture in the second locking member when the first locking member is in the closed position.

34. The release mechanism according to claim 33, wherein the second locking member is a loop pivotally connected to the proximal end of one of the bangle members and the first locking member is hook-shaped to engage the aperture in the first locking member.

35. The release mechanism according to claim 28, wherein the release mechanism is configured to permit a user to release the first locking member from the closed position with one hand.

36. The release mechanism according to claim 35, wherein the release mechanism is configured to permit the user to release the first locking member from the closed position by squeezing the pivotally connected bangle members between two digits on the one hand to apply the force on the pivotally connected bangle members.

* * * * *